US005183202A

United States Patent [19]

Love

[11] Patent Number: 5,183,202

[45] Date of Patent: Feb. 2, 1993

[54] RECLOSABLE DISPENSER CARTON

[75] Inventor: Marc C. Love, Goshen, Ind.

[73] Assignee: Atlas Die, Inc., Elkhart, Ind.

[21] Appl. No.: 789,327

[22] Filed: Nov. 8, 1991

[51] Int. Cl.[5] ..... B65D 5/66

[52] U.S. Cl. ..... 229/123; 206/268; 206/273; 229/130; 229/160.1

[58] Field of Search ..... 229/19, 20, 123, 130, 229/160.1; 206/251, 261, 268, 273

[56] References Cited

U.S. PATENT DOCUMENTS

| | | | |
|---|---|---|---|
| 340,904 | 4/1886 | Auchterlonie | 229/160.1 |
| 1,648,156 | 11/1927 | Tejada | 206/273 |
| 1,865,608 | 7/1932 | Andrews | 229/130 |
| 2,368,864 | 2/1945 | Molet | 229/130 |
| 2,950,060 | 8/1960 | Rudeen | 206/273 |
| 3,214,009 | 10/1965 | Tamarin | 206/273 |
| 3,669,341 | 6/1972 | Hughes | 229/123 |
| 4,066,205 | 1/1978 | Griffith | 229/123 |
| 4,199,063 | 4/1980 | Dutcher | 229/130 |
| 4,317,536 | 3/1982 | Dickerson | 229/123 |

FOREIGN PATENT DOCUMENTS

| | | | |
|---|---|---|---|
| 572120 | 5/1962 | Belgium | 229/160.1 |
| 717593 | 1/1932 | France | 229/160.1 |
| 1058428 | 5/1959 | German Democratic Rep. | 229/160.1 |
| 1069063 | 11/1959 | German Democratic Rep. | 206/268 |
| 904183 | 8/1962 | United Kingdom | 229/160.1 |

*Primary Examiner*—Gary E. Elkins

[57] ABSTRACT

A folding carton design consisting of 23 working panels, 22 fold lines, and 1 round hole. The design incorporates an opening/reclosing feature which opens to allow access to the contents of the carton, then recloses in a secure fashion.

The opening/reclosing feature utilizes an overlapping, double closure system guided by rounded side guides. The side guides incorporate stop tabs which act to prevent the box from opening to a point where the overlapping closure would be dislodged. Upon closure, the side guides are retracted into the body of the carton and hidden from view.

5 Claims, 4 Drawing Sheets

RECLOSABLE DISPENSER CARTON

BACKGROUND AND SUMMARY OF THE INVENTION

This invention relates to a design for a folding carton, and specifically to a unique opening/reclosing feature incorporated into the design.

The paperboard converting and packaging industry makes use of a vast array of known carton designs. Of these, a number are intended for use as dispenser type boxes. To be effective, a dispenser box must incorporate some type of feature in its design which allows the box to be opened, a portion of the contents removed, then reclosed in a manner that contains the remaining contents securely. It is desireable for the box to reclose in a semi-tight fashion which would serve to retain the freshness of the product contained within.

A typical example of this type of package is the traditional flip top box manufactured for cigarrette packaging. Flip top boxes have been manufactured for a number of years with many variations. Most designs of this type are now in public domain. Generally, this type of package is designed with a single fold over cover or lid which is hinged, along a fold line, to allow the carton to open and reclose.

For the purpose of example, the proposed invention was designed and proportioned to approximate the size of a typical cigarrette package. However, the design is not limited to this use. Other possible applications would include, but not be limited to: Packaging for candy, crayons, pencils, cigars, or any of a variety of products which would usually be dispensed in individual portions.

The dimensions and proportions of the design will vary dependent on the size requirements of the package contents.

The uniqueness of the present invention lies in the utilization of an overlapping double closure feature and curved side guides which allow the box to open wide, then smoothly reclose and hold position in a secure fashion. Semi-circular stop tabs on the ends of the side guides prevent the box from opening to a point where the opening feature could become dislodged.

By virtue of said opening/reclosing feature, the invention exceeds current designs by offering better access to the box's contents, and more completely enclosing and securing the contents upon closure.

In addition, designs currently in use (for flip top cigarrette boxes) utilize a two piece construction with an inner sleve being required to complete the package. The current invention surpasses older designs in that no inner sleve is required for the carton to function correctly.

Lastly, the invention presents a new, more novel approach which may appeal to the consumer based on its novelty alone.

BRIEF DESCRIPTION OF DRAWINGS

For the purpose of clarification, the present invention will be illustrated by a detailed description of the preferred embodiment which will make reference to a series of accompanying drawings. Components of the drawings will be identified through the use of numeric and alphabetical characters referencing the drawings to the description.

DETAILED DESCRIPTION OF THE PREFERRED EMBODIMENT

Figure 1:
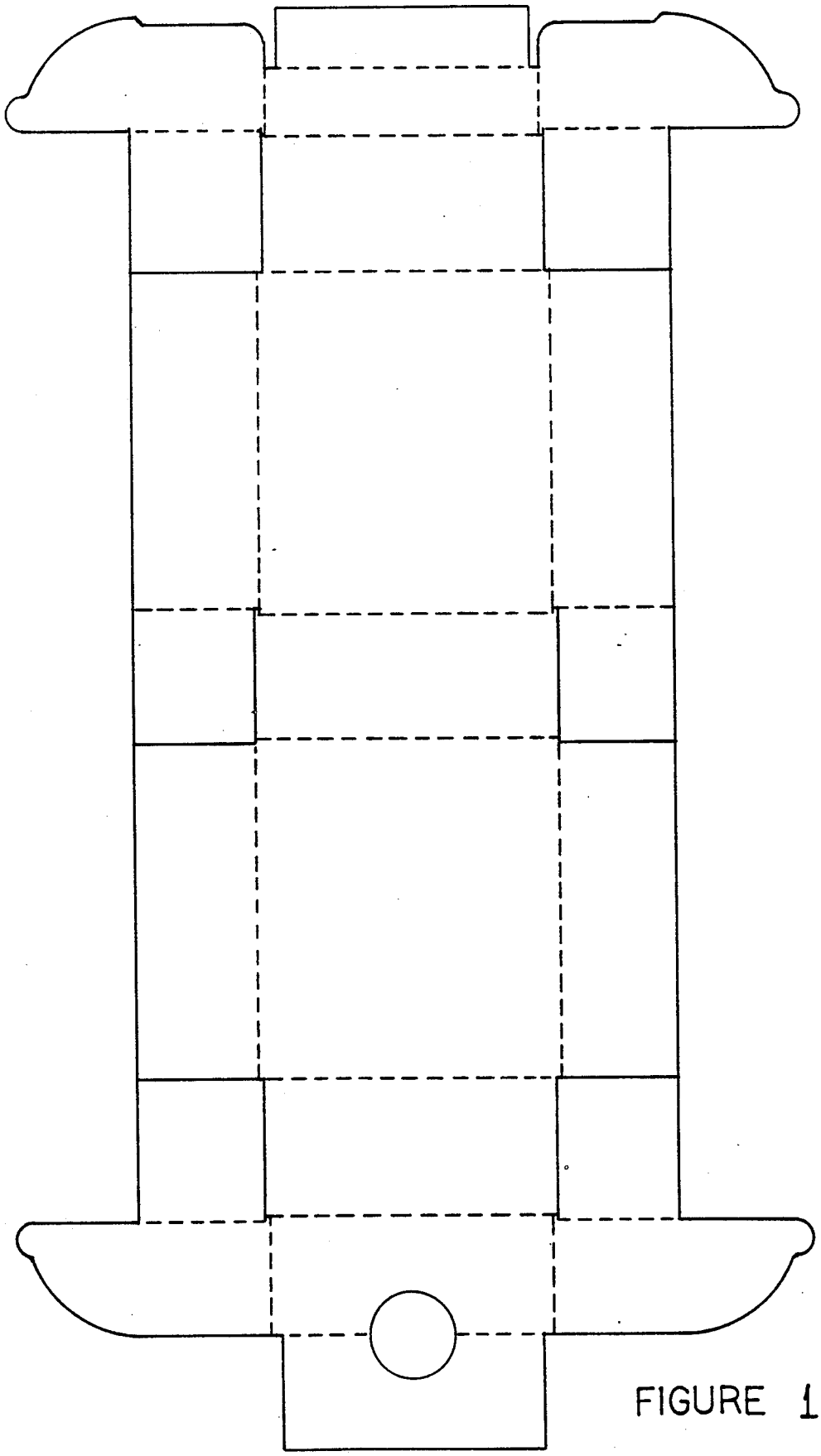
FIG. 1: A plan view of the carton blank before folding.

The basic carton blank, in flat form before folding or forming, is illustrated in FIG. 1. The preferred embodiment illustrated is not intended to be exhaustive or to limit the invention to the precise form shown. It has been chosen in order to best explain the invention and to enable others skilled in the art to best utilize the invention.

In order to eliminate unnecessary descriptive material, exact dimensions are not specified in FIG. 1. There are, however, certain dimensional relationships which must be maintained for carton function. These relationships are described below and illustrated in FIG. 2. The relationships are general and may vary slightly to accomodate variations in the type and thickness of the material used to construct the carton.

It should be noted that the majority of folding cartons of this type are die cut and creased with modern manufacturing techniques which are known and understood throughout the related industry. Since the present invention relates to design only, no description will be made regarding manufacturing methods.

Figure 2:
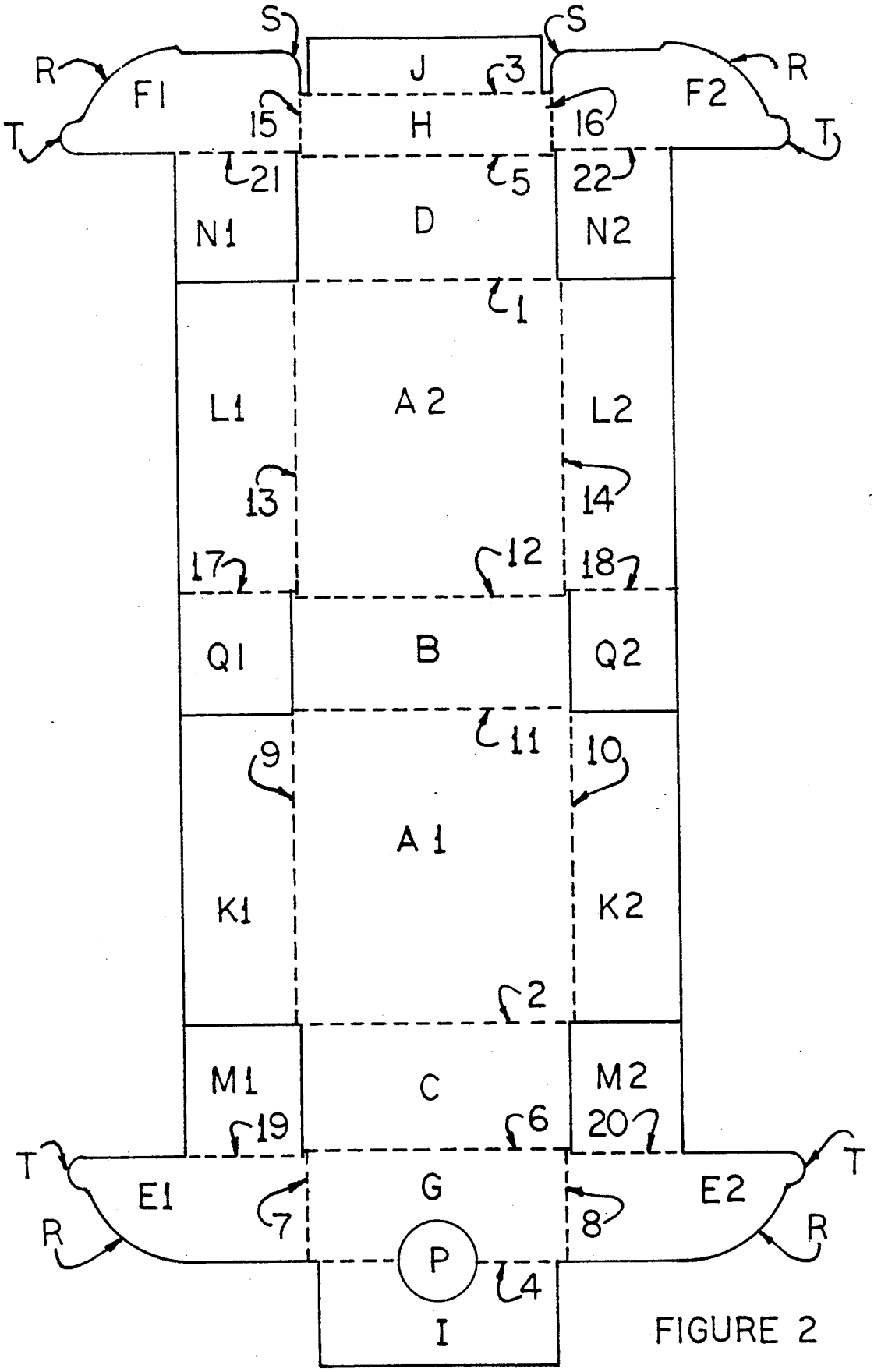
FIG. 2: A plan view of the carton blank with numerical and alphabetical identification of panels and fold lines.

In the following description, the term board caliper will be used to describe the thickness of the paperboard used in the manufacture of the carton. Also note that the term panel height refers to the vertical dimension of the panel as shown in FIGS. 1 and 2. Conversely, the term panel width refers to the horizontal dimension of the panel as shown in FIGS. 1 and 2.

DIMENSIONAL RELATIONSHIPS

The width and height of panels A1 and B will be determined by the general size requirements of the contents of the box. The height of panel A2 is the same as A1, but the width of A2 is equal to A1 minus two times the board caliper. The height of panel C, in combination with the height of panel A, is determined by the requirements of the carton contents. The width of panel C is equal to the width of panel Al minus two times the board caliper.

The height of panel D is equal to the height of panel C minus two times the board caliper. The width of panel D is equal to the width of panel A2 minus two times the board caliper. Radius R on guide flaps E1-,E2,F1,F2 is equal to the height of panel B minus the board caliper. The width of guide flaps E1 and E2, excluding the stop tab T, is equal to the height of panel C plus radius R. The height of guide flaps E1 and E2 is equal to the height of panel G minus the board caliper. The width of guide flaps F1 and F2, excluding the stop tab T, is equal to the height of panel D plus radius R. The height of guide flaps F1 and F2 is the same as guide flaps E1 and E2. Note that the upper edge of guide flaps F1 and F2 must be relieved approximately three times the board caliper to allow clearance during forming. The height of panel G is equal to The height of panel B minus one board caliper. The width of panel G is equal to the width of panel C minus two times the board caliper. The width of panel H is equal to the width of panel D minus two times the board caliper. The height of panel H is approximately two thirds the height of panel G. Panel J is variable, but must be somewhat smaller, in width and height, than panel H. Panel I is variable, but must be somewhat smaller, in width and height, than panel G. The height of panels K1, K2 is equal to the height of panel A1 minus one board caliper. The width of panels K1, K2 is equal to the height of panel B minus approximately three times board caliper. The height of panels L1, L2 is equal to the height of panel A2 minus one board caliper. The width of panels L1, L2 is equal to the width of panels K1, K2 plus one board caliper. The height of panels M1, M2 is equal to panel C plus one board caliper. The width of panels M1, M2 is equal to the width of panels K1, K2 plus the board caliper. The height of panels N1, N2 is equal to the height of panel D plus one board caliper. The width of panels N1, N2 is equal to the width of panels L1, L2 plus one board caliper. The diameter of hole P is variable. The height of panels Q1, Q2 is equal to the height of panel B plus two times board caliper. The width of panels Q1, Q2 is the same as the width of panels K1, K2. The size and radius of the stop tabs T, on the ends of the guide flaps, is variable. The size of radius S is also variable.

All offsets of fold lines shown in FIG. 2, are equal to the board caliper. Note that the solid lines shown in FIGS. 1 and 2 represent cut lines, in other words define the actual cut out shape of the carton blank. The dashed lines represent fold lines.

FORMING THE CARTON

The 23 panels, 22 crease lines and 1 round hole which make up the carton design are illustrated in FIG. 2. Following is a description of the process of forming the panels into the finished carton or box.

For purpose of clarification, it should be noted that the inside of the box is shown in FIGS. 1 and 2. Therefore all folding action is in the same direction, upwards toward the viewer.

Also note that it is a common and understood practice to glue certain carton panels together as a part of the manufacturing process. Since the gluing procedure does not constitute the invention per se, a description of the gluing process will be omitted and the process will be described simply as gluing.

Figure 3:
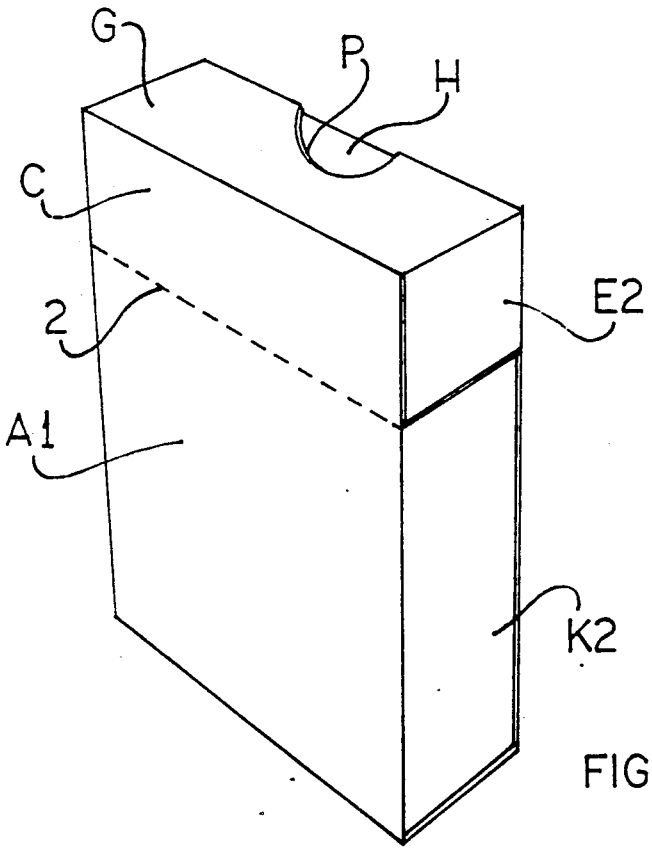
FIG. 3: A perspective view of the formed carton.
Figure 5:
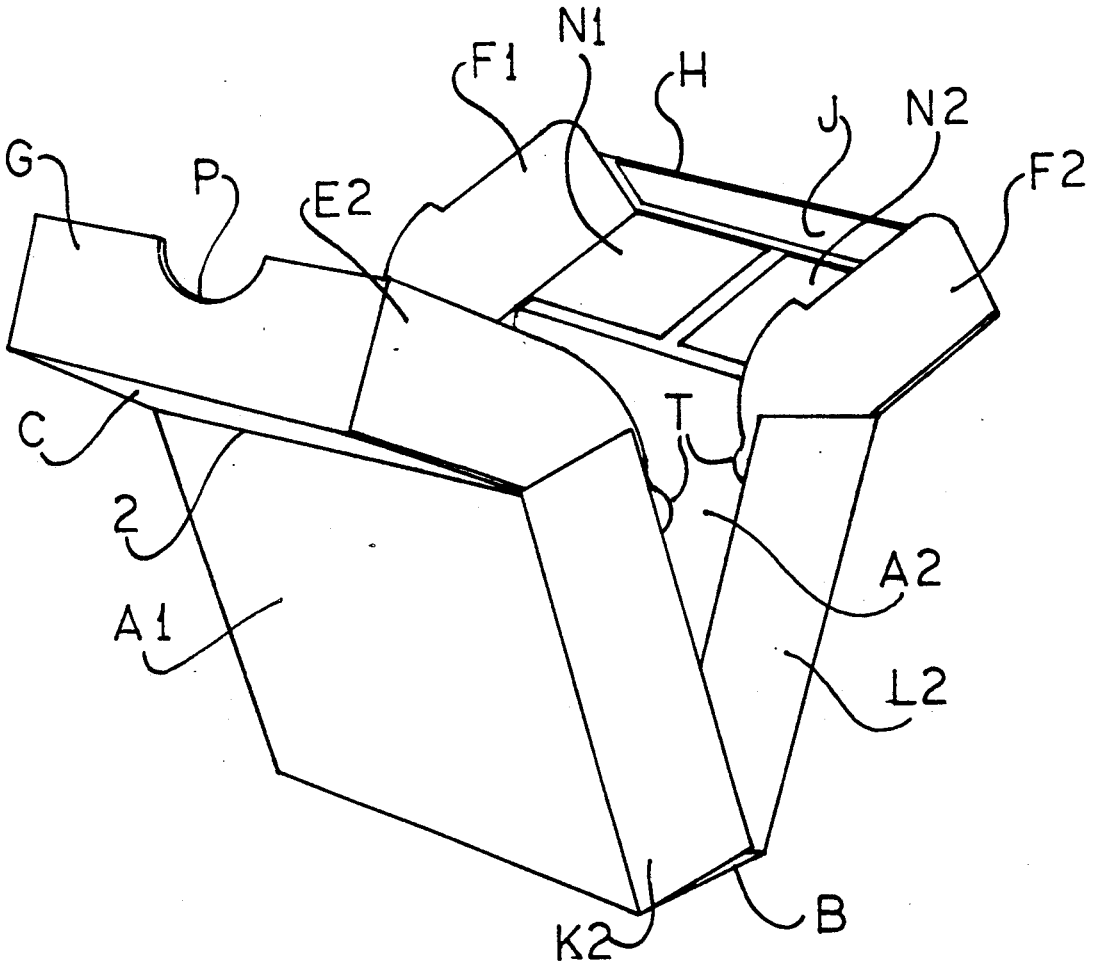
FIG. 5: An exploded perspective view of the partially formed carton exposing the guide flaps and stop tabs.

Reinforcing panel J folds 180 degrees along crease line 3 and glues to inner top panel H. Reinforcing panel I folds 180 degrees along crease line 4 and glues to outer top panel G coincidentally forming the semi-circular thumb notch P. Crease lines 6,7,8,19,20 fold to a 90 degree angle. Front glue flaps M1 and M2 glue to upper front panel C. Crease lines 15, 16,5,21,22 fold to a 90 degree angle. Rear glue flaps N1 and N2 glue to upper back panel D. Crease lines 11,12,13,14,17, 18 fold to a 90 degree angle. Bottom glue flaps Q1 and Q2 glue to bottom panel B, thereby bringing lower front and back panels A1 and A2 into a parallel position (Best seen in FIG. 5). As front and back panels A1 and A2 move into position, front outer guide flaps E1 and E2 enclose around rear inner guide flaps F1 and F2, and are, in turn, captured within inner side panels L1 and L2. Concurrently, outer top panel G fits over and around inner top panel H. Crease lines 9 and 10 fold to 90 degrees. Outer side panels K1 and K2 fold over and glue to inner side panels L1 and L2. See FIG. 3 for a view of the finished carton.

Figure 4:
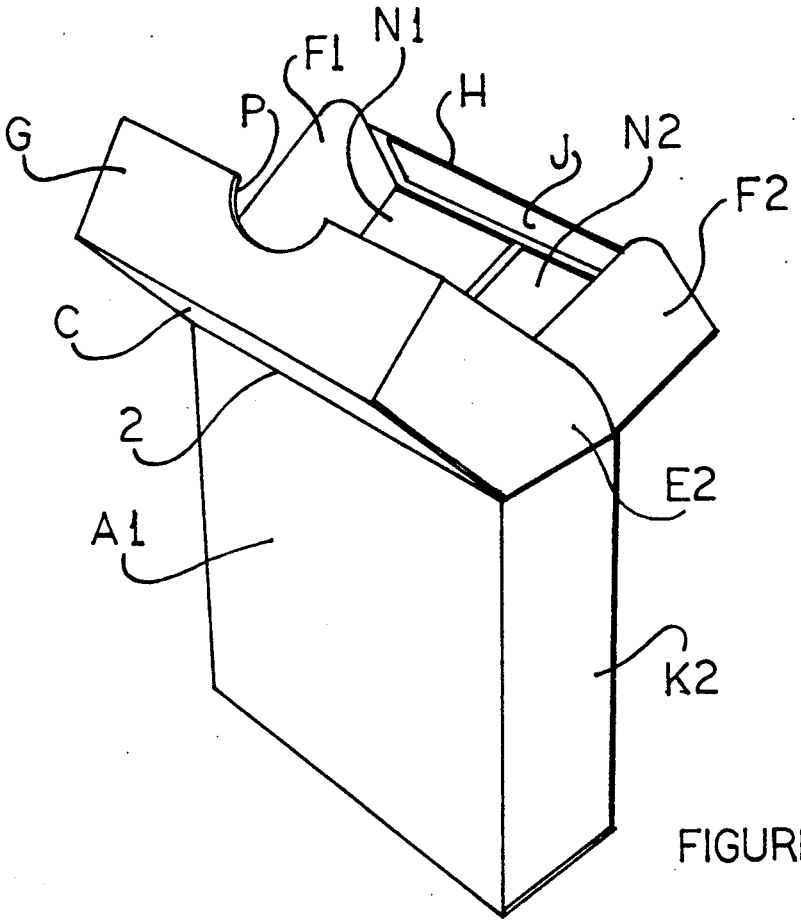
FIG. 4: A perspective view of the carton with opening/reclosing feature in fully opened position.

Note that fold lines 1 and 2 are not folded during the initial forming of the carton. These fold lines are utilized as hinge scores which allow the carton to open and reclose while in use. Refer to FIG. 4 for a view of the carton with the hinge scores in use and the opening feature fully extended.

What is claimed is:

1. A carton formed from a unitary carton blank, comprising:

rectangular shaped lower front, lower back, bottom and lower side panels connected along a plurality of crease lines; and an overlapping double closure means for providing reclosable access to the contents of said carton, said overlapping double closure means including (a) a front outer closure including an upper front panel, a top panel and a pair of upper side panels, said upper front panel hingedly connected to said front panel along a first of said crease lines, and (b) a rear inner closure including an upper front panel, a top panel and a pair of upper side panels, said rear inner closure upper front panel hingedly connected to said lower back panel along a second of said crease lines, said rear inner closure received within said front outer closure when said carton is closed, each of said closures further having a pair of guide flaps extending from said upper side panels, said guide flaps retracting within said lower side panels when said closures are closed and extending therefrom when said closures are opened, said guide flaps on said front outer closure overlapping said guide flaps on said rear inner closure.

2. The carton of claim 1 wherein each of said guide flaps having a plurality of stop tabs extending therefrom limiting the opening movement of said closures by interference with an opposed one of said lower front and lower back panels.

3. The carton of claim 2 wherein each of said lower side panels are formed by a pair of overlapping panel segments extending from said lower front and lower back panels.

4. The carton of claim 3 wherein said guide flaps have a curved portion and said stop tabs have a part circular shape.

5. The carton of claim 4 wherein said top panel of said front outer closure includes a recess shaped to define a thumb tab.

* * * * *

UNITED STATES PATENT AND TRADEMARK OFFICE

CERTIFICATE OF CORRECTION

PATENT NO. : 5,183,202

DATED : February 2, 1993

INVENTOR(S) : Marc C. Love

It is certified that error appears in the above-identified patent and that said Letters Patent is hereby corrected as shown below:

In column 2, at line 56, "El-" should read --El--.

Signed and Sealed this

Eighteenth Day of January, 1994

*Attest:*

Bruce Lehman

BRUCE LEHMAN

*Attesting Officer*

*Commissioner of Patents and Trademarks*